US011097152B2

(12) United States Patent
Lu

(10) Patent No.: US 11,097,152 B2
(45) Date of Patent: Aug. 24, 2021

(54) EXERCISE BOARD

(71) Applicant: Xiamen Sheep Anti-Fatigue Mat Co., Ltd., Xiamen (CN)

(72) Inventor: Xiangyang Lu, Xiamen (CN)

(73) Assignee: XIAMEN SHEEP ANTI-FATIGUE MAT CO., LTD., Xiamen (CN)

( * ) Notice: Subject to any disclaimer, the term of this patent is extended or adjusted under 35 U.S.C. 154(b) by 57 days.

(21) Appl. No.: 16/420,208

(22) Filed: May 23, 2019

(65) Prior Publication Data

US 2019/0358488 A1 Nov. 28, 2019

(30) Foreign Application Priority Data

May 25, 2018 (CN) ..... 201820792957.8

(51) Int. Cl.
*A63B 22/16* (2006.01)
*A63B 21/00* (2006.01)
*A63B 26/00* (2006.01)

(52) U.S. Cl.
CPC ..... *A63B 22/16* (2013.01); *A63B 21/0004* (2013.01); *A63B 26/003* (2013.01); *A63B 2209/10* (2013.01); *A63B 2209/14* (2013.01)

(58) Field of Classification Search
CPC ..... A63B 23/0211; A63B 26/003; A63B 2209/10; A63B 2209/14; A63B 6/00; A63B 6/02; A63B 6/025; A63B 21/4035; A63B 21/4039; A63B 21/0557; A63B 23/0216; A63B 22/16; A63B 21/0004
See application file for complete search history.

(56) References Cited

U.S. PATENT DOCUMENTS

2018/0318637 A1* 11/2018 Chapman ..... A63B 23/03508

* cited by examiner

*Primary Examiner* — Nyca T Nguyen
*Assistant Examiner* — Andrew M Kobylarz
(74) *Attorney, Agent, or Firm* — Bayramoglu Law Offices LLC

(57) ABSTRACT

An exercise board includes a main body and an elastic body configured on an upper surface of the main body. The upper surface of the main body is provided with at least one cavity, the cavity at least includes a first cavity part and a second cavity part, the first cavity part is located above the second cavity part, and a diameter of the first cavity part is less than that of the second cavity part. A lower surface of the elastic body is provided with at least one protrusion connected to the cavity, the protrusion at least includes a first protrusion part and a second protrusion part, the first protrusion part is located above the second protrusion part, and shapes of the first protrusion part and the second protrusion part match with shapes of the first cavity part and second cavity part.

16 Claims, 8 Drawing Sheets

EXERCISE BOARD

CROSS REFERENCE TO RELATED APPLICATIONS

This application is based upon and claims priority to Chinese Patent Application No. 201820792957.8, filed on May 25, 2018 and the entire contents of which are incorporated herein by reference.

TECHNICAL FIELD

The present invention relates to the field of an exercise apparatus, particularly to an exercise board.

BACKGROUND

In recent years, exercise boards have become popular in the market. There are many types of exercise boards such as wobble board, balance board, platform board, etc. One common type of exercise board basically includes an elastic body and a main body. Since the elastic body of the exercise board is usually attached to the main body by an adhesive in the prior art, the exercise board is subjected to constant, repeat, and irregular stresses. Problems such as adhesive failure, bubbling, detachment, edge cracks, edge curl occur easily after long-term use. Therefore, it is imperative to develop an exercise board which has a firmer bonding between different parts while its manufacturing is simple and cost-effective.

SUMMARY

In order to solve the above technical problems, the present invention provides an exercise board, which includes a main body, an elastic body configured on an upper surface of the main body. The upper surface of the main body is provided with at least one cavity, and the cavity at least includes a first cavity part and a second cavity part. The first cavity part is located above the second cavity part, and the diameter of the first cavity part is less than that of the second cavity part. A lower surface of the elastic body is provided with at least one protrusion connected to the cavity. The protrusion includes a first protrusion part and a second protrusion part. The first protrusion part is located above the second protrusion part. Shapes of the first protrusion part and the second protrusion part match with shapes of the first cavity part and second cavity part.

Preferably, sizes of the first protrusion part and the second protrusion part are greater than, equal to, or smaller than that of the first cavity part and second cavity part.

Preferably, a lower edge of the elastic body is provided with a male connection part, and the upper surface of the main body is provided with a female connection part at a position corresponding to the male connection part. The male connection part is connected to the female connection part.

Preferably, the male connection part is a ridge extending along the lower edge of the elastic body, and the female connection part is a groove extending along an upper edge of the main body, and an outer wall of the groove surrounds or does not surround an outer wall of the ridge.

Preferably, the male connection part extends to a lower surface of the main body and the female connection part is a side edge of the main body. The female connection part is enclosed by the male connection part, and a part of the male connection part on the lower surface of the main body completely or incompletely covers the lower surface of the main body.

Preferably, the exercise board further includes a rubber layer attached to a lower surface of the main body by an adhesive, the cavity runs through the main body and the protrusion extends along the cavity to make contact with the rubber layer, and a lower surface of the rubber layer is provided with an anti-slip texture.

Preferably, the exercise board is arc-shaped.

Preferably, the main body and the elastic body are flat, the exercise board further includes a plurality of transverse arc plates and a plurality of longitudinal arc plates, the plurality of transverse arc plates have different curvatures, the plurality of longitudinal arc plates have different curvatures, and straight sides of at least one transverse arc plate and at least one longitudinal arc plate are detachably fixed at the lower surface of the main body through a connection means. The transverse arc plate and the longitudinal arc plate detachably fixed at the lower surface of the main body have the same or different curvatures and can be replaced with other transverse arc plates and longitudinal arc plates for flexibly changing the curvature of the arc plates as needed.

Preferably, the connection means is a mortise and tenon joint. The mortise and tenon joint includes holders and insertion ribs matched with the holders. The holders are provided on the lower surface of the main body, the insertion ribs are provided on side walls of the arc plates, and the insertion ribs are inserted into the holders.

Preferably, the elastic body is made of a foam material or a foam material covered with a composite layer, the foam material is filled in the cavity of the main body and formed to be tightly connected to the cavity, then the composite layer is integrally formed on the foam material.

Preferably, the foam material is polyurethane, and the composite layer is a leather layer.

Preferably, the elastic body is made of a fluid material and a cover layer. The fluid material is filled between the cover layer and the main body. The cover layer is connected to the main body.

Preferably, the fluid material is foam beads, water, liquid with therapy effect, rubber, gel, rubber beads, or any other material that is suitable for applying in the exercise board. The cover layer is made of leather, fabrics, water-proof cloth, or any other material that is suitable for applying in the exercise board.

Preferably, the main body is a plywood plate, a wooden plate, or a plastic plate.

Preferably, an upper surface of the elastic body is provided with a plurality of projections for massage and anti-slip purpose.

Preferably, an angle of osculation of a vertex of the curvature of the arc plates or an arc shape of the main body ranges from 5°-20°.

Preferably, the angle of osculation of the vertex of the curvature of the arc plates or the arc shape of the main body is 8.5°.

Preferably, the exercise board is provided with at least one through hole for grabbing or hanging over, etc.

According to the present invention, the structure for connecting different parts of the exercise board not only makes the product more durable without using any fastening components, but also has a simple manufacturing process. With such structure, the bonding strength between the elastic body and the main body is greatly improved. Also, since the curvature of the exercise board can be changed by replacing the arc plates with different curvatures, the use of the exercise board is more flexible.

DETAILED DESCRIPTION OF THE EMBODIMENTS

Figure 1:
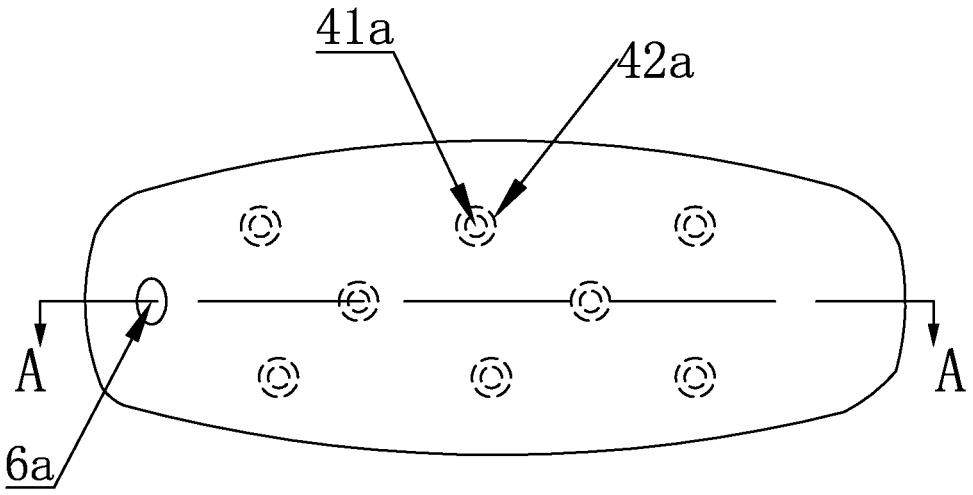
FIG. 1 is a top view of a main body of an exercise board according to one embodiment of the present invention.

The embodiments of the present invention will be clarified hereinafter with reference to the drawings. The described embodiments are merely a part of the embodiments of the present invention rather than all of them. Other embodiments that can be derived by those of ordinary skill in the art based on the embodiments of the present invention without creative efforts should also be considered as falling within the scope of the present invention.

In the present invention, unless otherwise specified, the terms such as "upper", "lower", "up", "down" indicate the orientation shown in the drawings to facilitate the illustration, and the present invention is not limited thereto. The terms such as "on", "above", "below", "under" do not necessarily mean direct or indirect contact of two elements, it should be determined case by case.

Embodiment 1

Figure 2A:
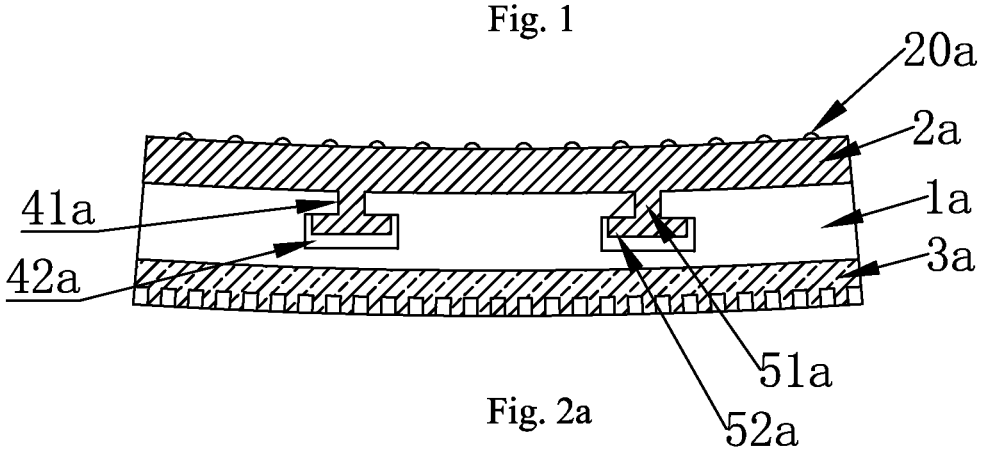
FIG. 2*a* is a cross-sectional view of an exercise board according to one embodiment of the present invention.
Figure 2B:
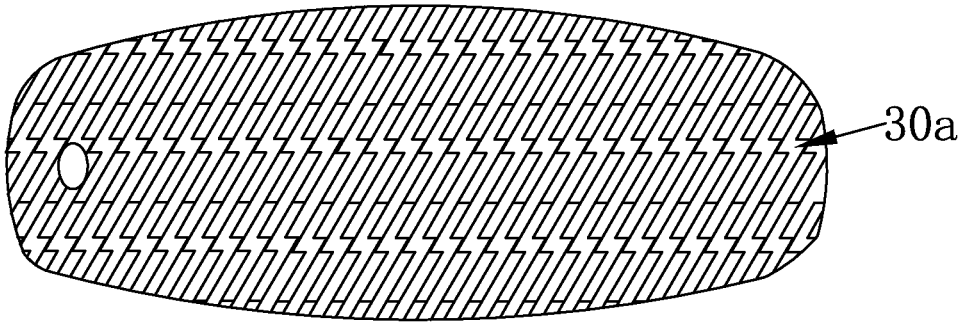
FIG. 2*b* is bottom view of an exercise board according to one embodiment of the present invention.

Referring to FIG. 1, FIG. 2*a*, and FIG. 2*b*, the present invention provides an exercise board, which includes the main body 1*a* and the elastic body 2*a* configured on an upper surface of the main body 1*a*. The rubber layer 3*a* is attached to a lower surface of the main body 1*a* by an adhesive. Alternatively, the rubber layer 3*a* may not be provided. The upper surface of the main body 1*a* is provided with at least one cavity, and the cavity at least includes the first cavity part 41*a* and the second cavity part 42*a*. The first cavity part 41*a* is located above the second cavity part 42*a*, and the diameter of the first cavity part 41*a* is less than that of the second cavity part 42*a*. Namely, the size of the cavity is gradually reduced from the lower side to the upper surface of the main body 1*a*. A lower surface of the elastic body 2*a* is provided with at least one protrusion connected to the cavity. The protrusion includes the first protrusion part 51*a* and the second protrusion part 52*a*. The first protrusion part 51*a* is located above the second protrusion part 52*a*. The shapes of the first protrusion part 51*a* and the second protrusion part 52*a* match with the shapes of the first cavity part 41*a* and second cavity part 42*a*. The cavity and protrusion may have any shape, such as round shape, rectangular shape, wavy shape, or any other regular or irregular shapes, etc. As a preferred embodiment shown in FIG. 1, the cavity is round-shaped. The main body 1*a* may be a plywood plate, a wooden plate, or a plastic plate, etc. The elastic body 2*a* may be made of a foam material or a foam material covered with a leather layer. The foam material is filled in the cavity of the main body 1*a* and formed to be tightly connected to the cavity, then the leather layer is integrally formed on the foam material. Preferably, the foam material is polyurethane. Preferably, an upper surface of the elastic body 2*a* is provided with a plurality of projections 20*a* for massage, anti-slip, or other purposes. The projections 20*a* are shown in FIG. 2*a* for example, and the specific shape of the projections 20*a* may be other shapes such as irregular cobblestone shape, massage granule shape, etc. The elasticity of the elastic body 2*a* of the exercise board can release the fatigue of standing, the support of the main body 1*a* helps the user to train their muscles and strengthen their body, and the rubber layer 3*a* can avoid slip. The lower surface of the rubber layer 3*a* may be further provided with the texture 30*a* to enhance the anti-slip performance. The texture 30*a* of the rubber layer 3*a* is shown in FIG. 2*b* for example, and it may also be any other pattern that can realize the anti-slip purpose. According to the present invention, the bonding surface between the lower surface of the main body 1*a* and the rubber layer 3*a* is smooth, so the bonding strength is improved, the problems such as adhesive failure, bubbling, detachment, edge cracks, edge curl can be avoided, and the overall appearance is better. Moreover, the unique connection structure between the elastic layer 2*a* and the main body 1*a* also greatly improves the bonding strength of the elastic layer 2*a* and the main body 1*a*, thereby further prolonging the service life.

Preferably, the exercise board is arc-shaped. There is an angle of osculation between a connection line of the vertex (i.e. the contact point between the arc and the ground) and a highest point of the arc and the horizontal line. The angle of osculation ranges from 5°-20°. Preferably, the angle of osculation is 8.5° to provide the most comfortable design for the user to stand and better user experience.

Figure 3:
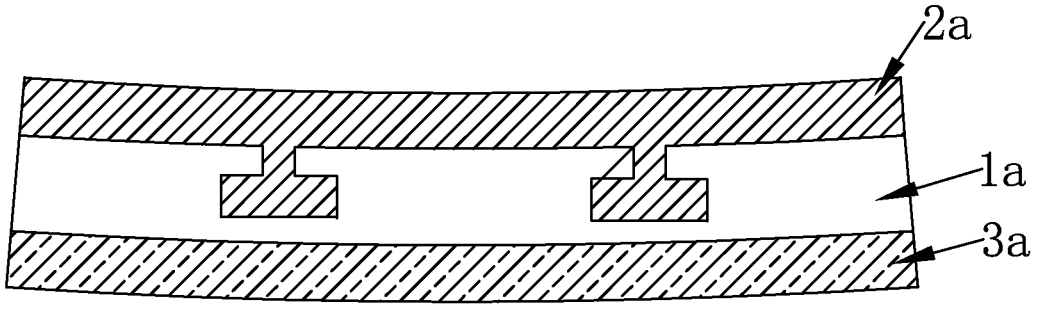
FIG. 3 is a cross-sectional view of an exercise board according to another embodiment of the present invention.

The sizes of the first protrusion part 51*a* and the second protrusion part 52*a* are greater than, equal to, or smaller than that (i.e. the sizes) of the first cavity part 41*a* and second cavity part 42*a*. As a preferred embodiment shown in FIG. 3, the sizes of the first protrusion part 51*a* and the second protrusion part 52*a* are greater than or equal to that (i.e. the sizes) of the first cavity part 41*a* and second cavity part 42*a* to be completely filled in and clamped by the cavity. With this configuration, a more compact structure and a tighter connection can be obtained. As shown in FIG. 2, the sizes of the first protrusion part 51*a* and the second protrusion part 52*a* may also be smaller than that (i.e. the sizes) of the first cavity part 41*a* and second cavity part 42*a*, so a gap is left between the protrusion and the cavity for buffering, and the amount of material can be reduced.

Figure 4:
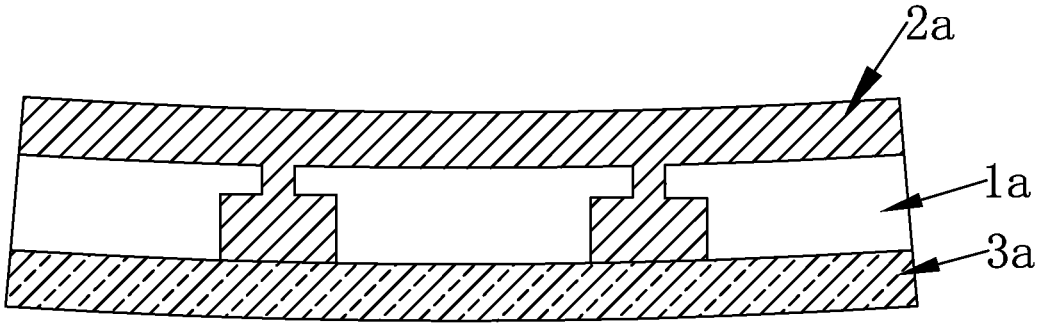
FIG. 4 is a cross-sectional view of an exercise board according to yet another embodiment of the present invention.

The cavity of the main body 1*a* may run through or not run through the main body 1*a*. As a preferred embodiment shown in FIG. 4, the cavity runs through the main body 1*a* until the lower surface of the protrusion of the elastic body 2*a* contacts with the rubber layer 3*a*. The protrusion of the elastic body 2*a* may extend out of the cavity to project from the lower surface of the main body 1*a* to increase the elasticity and anti-slip performance. Preferably, the lower surface of the protrusion and the main body 1*a* have the same curvature, so as to improve the goodness of fit of the main body 1*a* and the rubber layer 3*a*. By doing so, the difficulty in making the cavity can be reduced, and the bonding between the main body 1*a* and the elastic body 2*a* can be further improved.

Figure 5A:
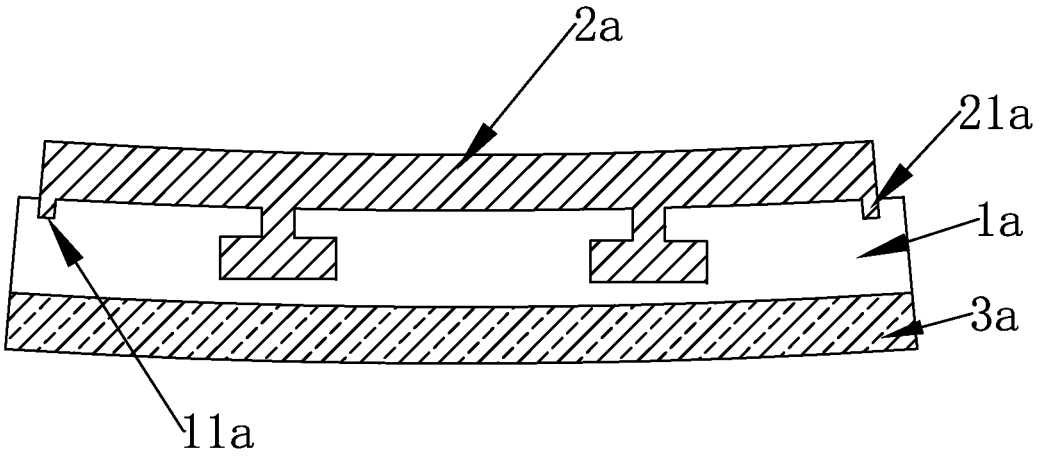
FIG. 5*a* is a cross-sectional view of an exercise board with a connection structure at the edges of the elastic body and the main body according to yet another embodiment of the present invention.
Figure 5B:
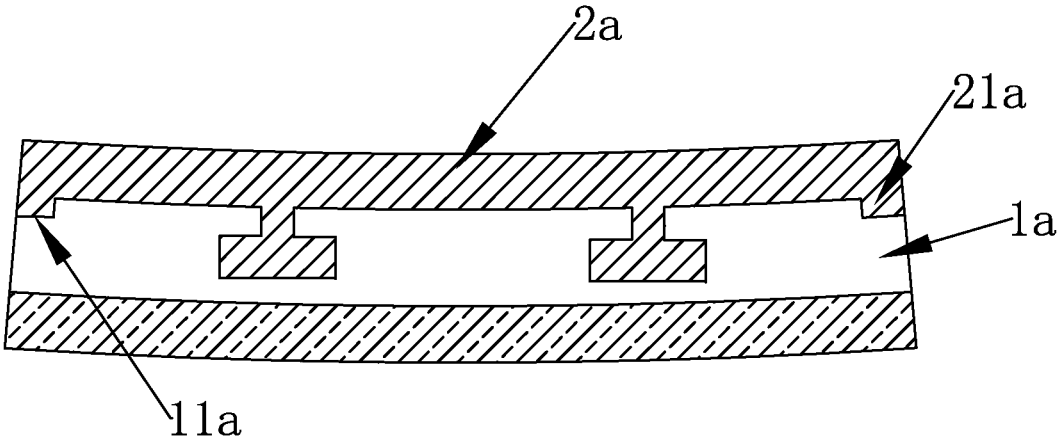
FIG. 5*b* is a cross-sectional view of an exercise board with a connection structure at the edges of the elastic body and the main body according to yet another embodiment of the present invention.

Alternatively, a lower edge of the elastic body 2*a* may be further provided with the male connection part 21*a*, and the upper surface of the main body 1*a* is provided with the female connection part 11*a* at a position corresponding to the male connection part 21*a*. The male connection part 21*a* is connected to the female connection part 11*a*. As a preferred embodiment shown in FIG. 5*a*, the male connection part 21*a* is a ridge extending along the lower edge of the elastic body 2*a*, and the female connection part 11*a* is a groove 11*a* extending along an upper edge of the main body 1*a*, and an outer wall of the groove surround an outer wall of the ridge. Also, as shown in FIG. 5*b*, the outer wall of the groove may not surround the outer wall of the ridge. In the case where the outer wall of the groove surrounds the outer wall of the ridge, the width of ridge may be slightly greater than that of the groove, owing to the elasticity of the elastic body 2*a*, the ridge can be tightly clamped in the groove. By doing so, the bonding of the elastic body 2*a* and the main body 1*a* can further be improved, and the appearance is better.

Figure 6A:
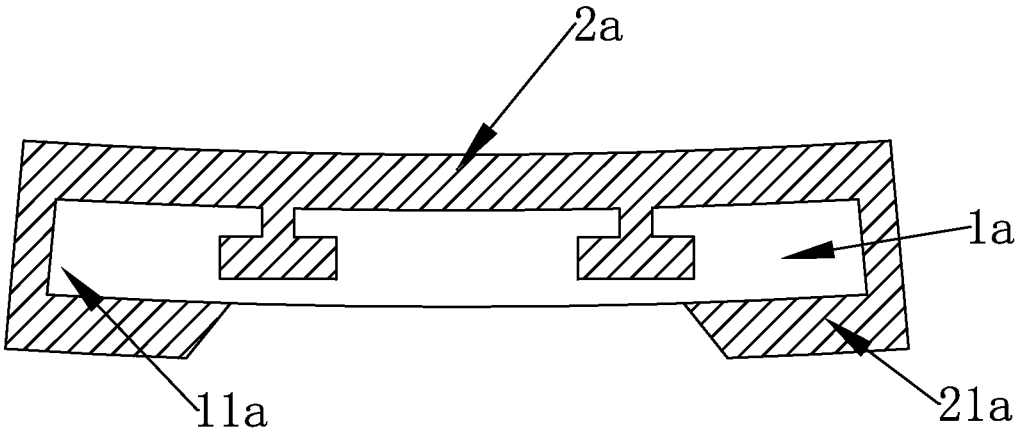
FIG. 6*a* is a cross-sectional view of an exercise board with a connection structure at the edges of the elastic body and the main body according to yet another embodiment of the present invention.
Figure 6B:
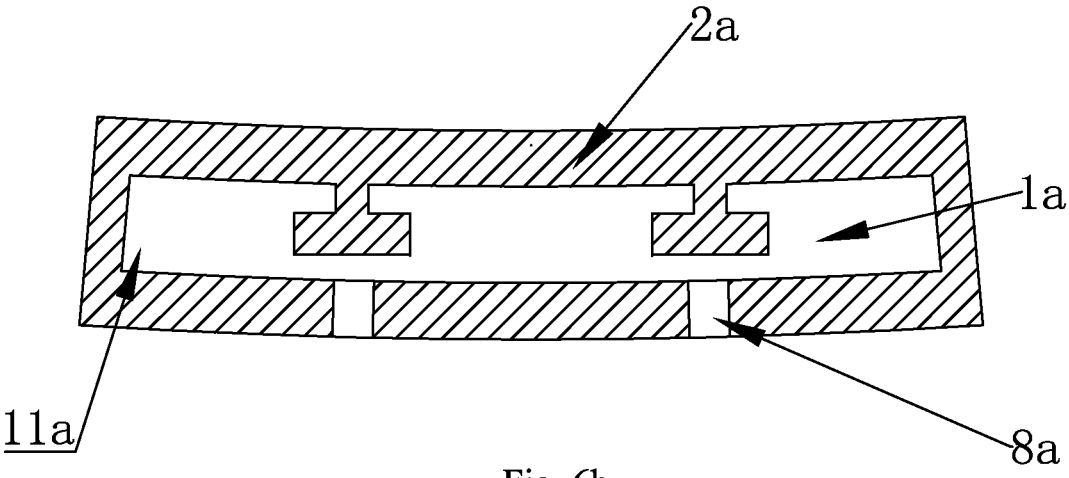
FIG. 6*b* is a cross-sectional view of an exercise board with a connection structure at the edges of the elastic body and the main body according to yet another embodiment of the present invention.

Alternatively, as shown in FIGS. 6*a* and 6*b*, the male connection part 21*a* extends to a lower surface of the main body 1*a* and the female connection part 11*a* is a side edge of the main body 1*a*. The female connection part 11*a* is enclosed by the male connection part 21*a*, and a part of the male connection part 21*a* on the lower surface of the main body 1*a* completely or incompletely covers the lower surface of the main body 1*a*. As shown in FIG. 6*b*, when the part of the male connection part 21*a* on the lower surface of the main body 1*a* completely covers the lower surface of the main body 1*a*, at least one grooves 8*a* is provided for connection with other components.

Alternatively, the exercise board may be further provided with at least one through hole 6*a* for grabbing or hanging over etc.

Embodiment 2

Figure 7:
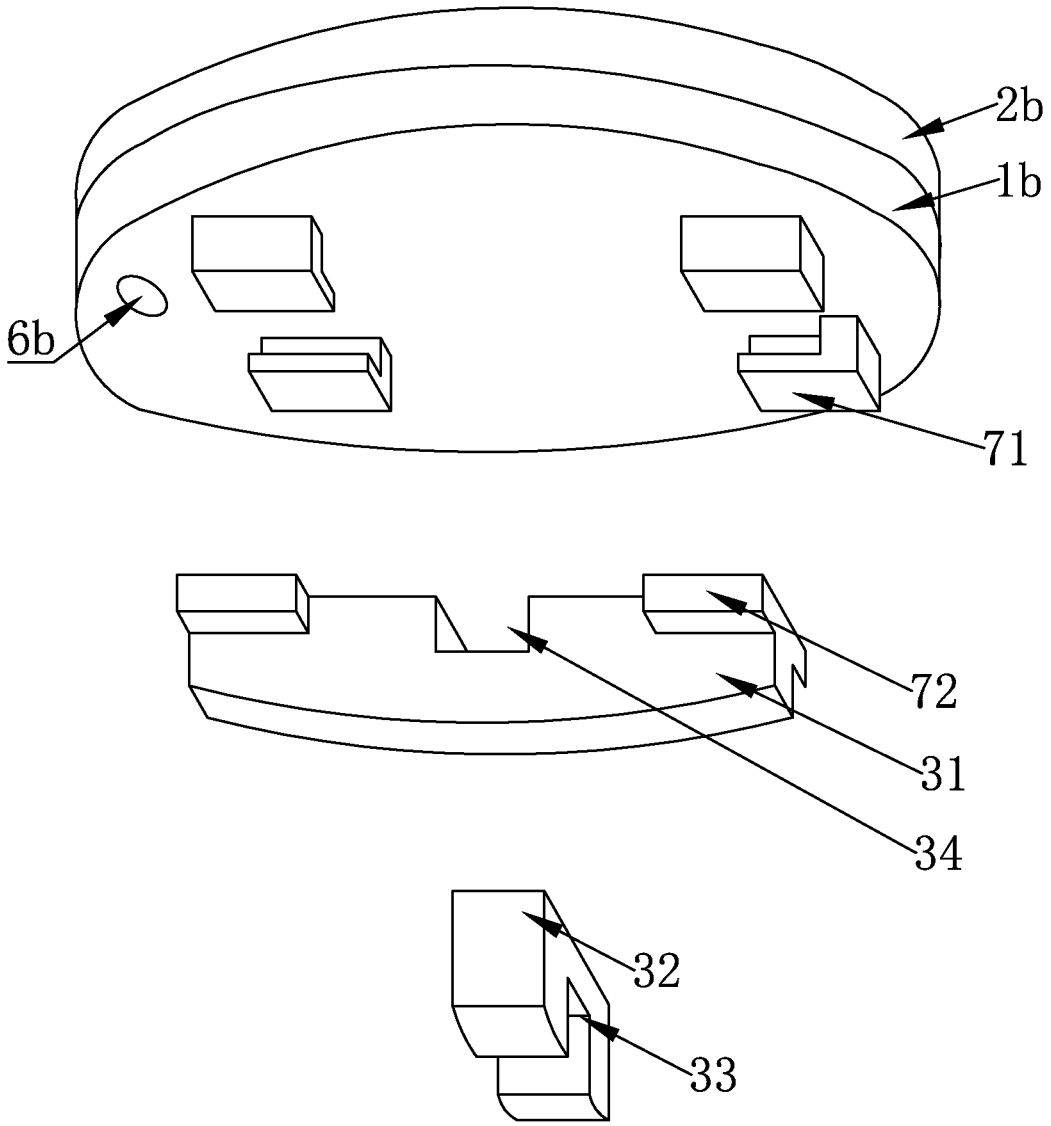
FIG. 7 is an exploded view of an exercise board with changeable arc plates according to yet another embodiment of the present invention.
Figure 8:
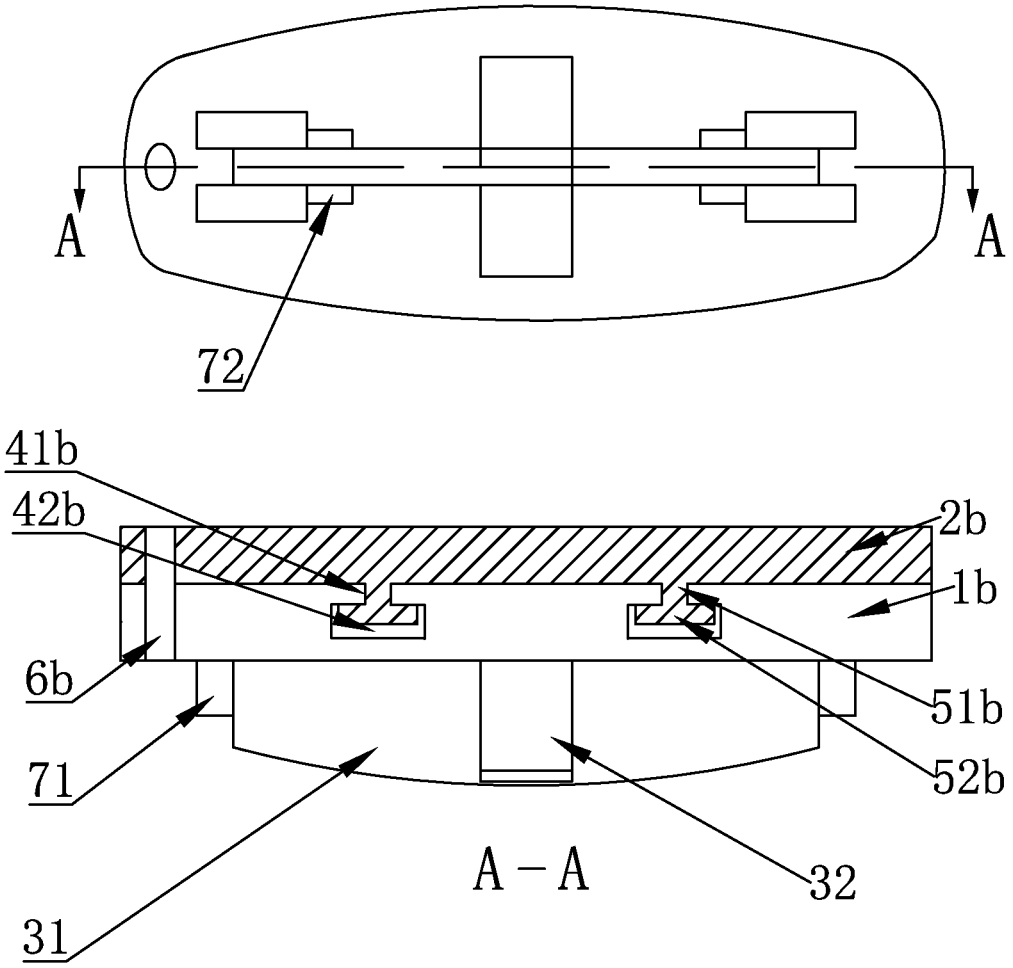
FIG. 8 is a cross-sectional view of an assembled exercise board shown in FIG. 7.
Figure 9:
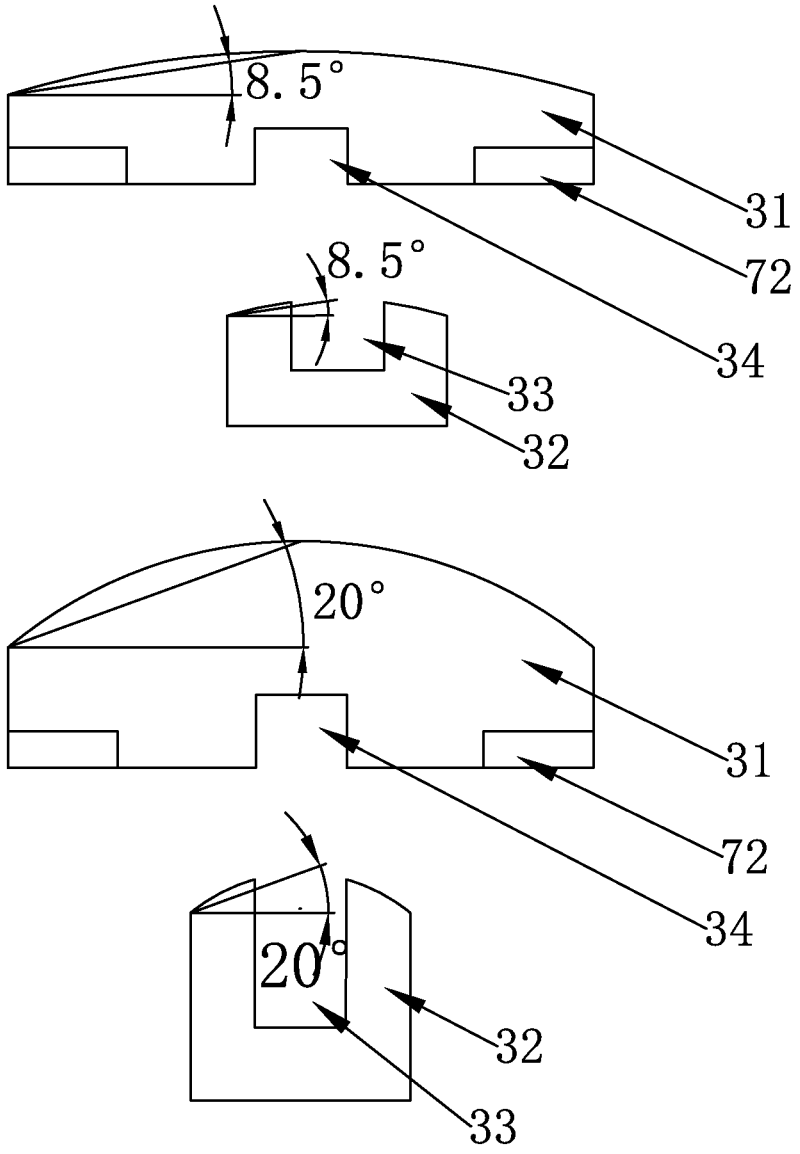
FIG. 9 is front view showing two sets of transverse arc plates and longitudinal arc plates with different curvatures.

Referring to FIG. 7 and FIG. 8, the present invention provides an exercise board including the main body 1*b* and the elastic body 2*b* located at an upper surface of the main body 1*b*. The main body 1*b* and the elastic body 2*b* are flat. The exercise board further includes at least one transverse arc plate 31 and at least longitudinal arc plate 32. The transverse arc plates 31 have different curvatures, the longitudinal arc plates 32 have different curvatures, and straight sides of the transverse arc plate 31 and longitudinal arc plate 32 are detachably fixed at the lower surface of the main body 1*b* through a connection means. The transverse arc plate 31 and the longitudinal arc plate 32 are detachably fixed at the lower surface of the main body 1*b* and have the same or different curvatures and can be replaced with other transverse arc plates 31 and longitudinal arc plates 32 for flexibly changing the curvature of the arc plates as needed. For instance, a first set of transverse arc plates 31 and longitudinal arc plates 32 and a second set of transverse arc plates 31 and longitudinal arc plates 32 have different curvatures and are shown in FIG. 9. FIG. 7 shows an exploded schematic diagram of how the first set of transverse arc plates 31 and longitudinal arc plates 32 are assembled with the main body 1*b*. FIG. 8 is a cross-sectional view of the assembled exercise board shown in FIG. 7. As shown in FIG. 7, when assembled, the groove 33 at the middle of the upper side of the longitudinal arc plate 32 is put into the groove 34 at the middle of the upper side of the transverse arc plate 31 to be fitted therein. Then the transverse arc plate 31 is connected to the lower surface of the main body 1*b* through the connection means.

As a preferred embodiment shown in FIG. 7, the connection means is a mortise and tenon joint. The mortise and tenon joint includes L-shaped holders 71 and insertion ribs 72 matched with the holders 71. The holders 71 are provided on the lower surface of the main body 1*b*, the insertion ribs 72 are provided on side walls of the transverse arc plates 31 to form a T-shaped cross section with the arc plates, and the insertion ribs 72 are inserted into the holders 71. The connection means may also be any other means that is suitable for detachably connecting the arc plates 31, 32 to the main body 1*b*. The mortise and tenon joint is merely an example, and the present invention is not limited thereto.

Preferably, similar to embodiment 1, the upper surface of the main body 1*b* is provided with at least one cavity, and the cavity at least includes the first cavity part 41*b* and the second cavity part 42*b*. The first cavity part 41*b* is located above the second cavity part 42*b*, and the diameter of the first cavity part 41*b* is less than that of the second cavity part 42*b*. Namely, the size of the cavity is gradually reduced from the lower side to the upper surface of the main body 1*b*. A lower surface of the elastic body 2*b* is provided with at least one protrusion connected to the cavity. The protrusion includes the first protrusion part 51*b* and the second protrusion part 52*b*. The first protrusion part 51*b* is located above the second protrusion part 52*b*. The shapes of the first protrusion part 51*b* and the second protrusion part 52*b* match with the shapes of the first cavity part 41*b* and second cavity part 42*b*. The cavity and protrusion may have any shape, such as round shape, rectangular shape, wavy shape, or any other regular or irregular shapes, etc. Other improvements described in embodiment 1, if suitable, can also be applied to embodiment 2, so they are not described in detail herein.

Preferably, the arc plates 31, 32 have an angle of osculation between a connection line of the vertex (i.e. the contact point between the arc and the ground) and a highest point of the arc and the horizontal line. The angle of osculation ranges from 5°-20°. Preferably, the angle of osculation is 8.5° to provide the most comfortable design for the user to stand and better user experience.

Embodiment 3

Figure 10:
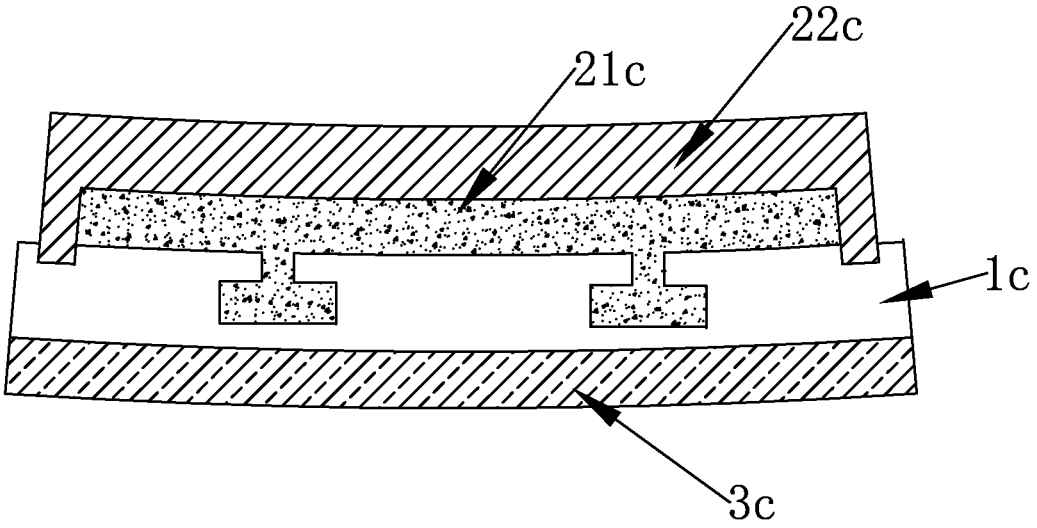
FIG. 10 is a cross-sectional view of an exercise board according to yet another embodiment of the present invention.

As shown in FIG. 10, the embodiment 3 is basically the same as the embodiment 1, the difference is that the elastic body 2*c* is made of the fluid material 21*c* and the cover layer 22*c*, the fluid material 21*c* is filled between the cover layer 22*c* and the main body 1*c*, and the cover layer 22*c* is connected to the main body 1*c*. The fluid material 21*c* may be foam beads, water, liquid or any material with therapy effect, rubber, gel, rubber beads, or any other material that is suitable for applying in the exercise board. The cover layer 22*c* is made of leather, fabrics, water-proof cloth, or any other material that is suitable for applying in the exercise board. By filling the fluid material 21*c* between the cover layer 22*c* and the main body 1*c*, the stress applied to the cover layer 22*c* is dispersed to the cavity of the main body 1*c* owing to the mobility of the fluid material 21*c*, so the stress applied to the edges of the cover layer 22*c* and the main body 1*c* is effectively reduced. Thus, the exercise board is more durable. In the case where the fluid material 21*c* is liquid or any material with therapy effect, the user is allowed to do exercise while curing disease, thus providing more diverse functions. Moreover, in the present embodiment, the cavity 4*c* cannot run through the main body 1*c*, so a closed space can be provided to hold the fluid material 21*c*.

The present embodiment may also be incorporated with embodiment 2 to allow the user to flexibly change the curvature of the exercise board while benefiting from the configuration of embodiment 3.

Although some of the embodiments of the present invention are described above, the present invention should not be limited thereto, and other embodiments should not be excluded from the present invention. The present invention may be modified according to the teaching disclosed above and other techniques or knowledge of related field based on the inventive concept of the present invention. Such modifications and variations made by those skilled in the art without departing from the spirit and scope of the present invention should also be considered as falling within the scope of the present invention.

What is claimed is:

1. An exercise board comprising a main body, an elastic body configured on an upper surface of the main body, and a rubber layer attached to a lower surface of the main body by an adhesive;

wherein, the upper surface of the main body is provided with at least one cavity, the at least one cavity comprises a first cavity part and a second cavity part, the first cavity part is located above the second cavity part, and a diameter of the first cavity part is less than a diameter of the second cavity part; and a lower surface of the elastic body is provided with at least one protrusion connected to the at least one cavity, the at least one protrusion comprises a first protrusion part and a second protrusion part, the first protrusion part is located above the second protrusion part, and shapes of the first protrusion part and the second protrusion part match with shapes of the first cavity part and second cavity part;

wherein the exercise board is arc-shaped;

wherein the elastic body is made of a foam material covered with a composite layer, the foam material is filled in the at least one cavity of the main body and formed to be tightly connected to the at least one cavity, then the composite layer is integrally formed on the foam material.

2. The exercise board of claim 1, wherein a lower surface of the rubber layer is provided with an anti-slip texture.

3. The exercise board of claim 2, wherein the main body is a plywood plate, a wooden plate, or a plastic plate.

4. The exercise board of claim 3, wherein an upper surface of the elastic body is provided with a plurality of projections for massage and anti-slip purpose.

5. The exercise board of claim 4, wherein the exercise board is provided with at least one through hole for grabbing or hanging over.

6. The exercise board of claim 1, wherein an angle of osculation of a vertex of an arc shape of the main body ranges from 5°-20°.

7. The exercise board of claim 6, wherein the angle of osculation of the vertex of the arc shape of the main body is 8.5°.

8. The exercise board of claim 1, wherein the foam material is polyurethane and the composite layer is a leather layer.

9. The exercise board of claim 1, wherein sizes of the first protrusion part and the second protrusion part are greater than or equal to sizes of the first cavity part and second cavity part.

10. The exercise board of claim 1, wherein sizes of the first protrusion part and the second protrusion part are smaller than sizes of the first cavity part and second cavity part.

11. An exercise board comprising a main body and an elastic body configured on an upper surface of the main body, wherein the main body and the elastic body are flat, the exercise board further comprises a plurality of transverse arc plates and a plurality of longitudinal arc plates;

the plurality of transverse arc plates have different curvatures, the plurality of longitudinal arc plates have different curvatures, and straight sides of at least one transverse arc plate and at least one longitudinal arc plate are detachably fixed at a lower surface of the main body through a connection means; and the at least one transverse arc plate and the at least one longitudinal arc plate detachably fixed at the lower surface of the main body have the same or different curvatures and can be replaced with other transverse arc plates and longitudinal arc plates for flexibly changing the curvature of the transverse arc plates and the longitudinal arc plates.

12. The exercise board of claim 11, wherein, the upper surface of the main body is provided with at least one cavity, the at least one cavity comprises a first cavity part and a second cavity part, the first cavity part is located above the second cavity part, and a diameter of the first cavity part is less than a diameter of the second cavity part; and a lower surface of the elastic body is provided with at least one protrusion connected to the at least one cavity, the at least one protrusion comprises a first protrusion part and a second protrusion part, the first protrusion part is located above the second protrusion part, and shapes of the first protrusion part and the second protrusion part match with shapes of the first cavity part and second cavity part.

13. The exercise board of claim 12, wherein the connection means is a mortise and tenon joint;

the mortise and tenon joint comprises an L-shaped holder and an insertion rib matched with the L-shaped holder; and the L-shaped holder is provided on the lower surface of the main body, the insertion rib is provided on side walls of the transverse arc plates to form a T-shaped cross section with the transverse arc plates, and the insertion rib is inserted into a groove.

14. An exercise board comprising a main body, an elastic body configured on an upper surface of the main body, and a rubber layer attached to a lower surface of the main body by an adhesive;

wherein, the upper surface of the main body is provided with at least one cavity, the at least one cavity comprises a first cavity part and a second cavity part, the first cavity part is located above the second cavity part, and a diameter of the first cavity part is less than a diameter of the second cavity part; and a lower surface of the elastic body is provided with at least one protrusion connected to the at least one cavity, the at least one protrusion comprises a first protrusion part and a second protrusion part, the first protrusion part is located above the second protrusion part, and shapes of the first protrusion part and the second protrusion part match with shapes of the first cavity part and second cavity part;

wherein the exercise board is arc-shaped;

wherein a lower edge of the elastic body is provided with a male connection part, an upper edge of the main body is provided with a female connection part at a position corresponding to the male connection part, and the male connection part is connected to the female connection part.

15. The exercise board of claim 14, wherein the male connection part is a ridge extending along the lower edge of the elastic body, and the female connection part is a groove extending along the upper edge of the main body, and an outer wall of the groove surrounds or does not surround an outer wall of the ridge.

16. The exercise board of claim 14, wherein the male connection part extends to a lower surface of the main body and the female connection part is a side edge of the main body;

the female connection part is enclosed by the male connection part, and a part of the male connection part on the lower surface of the main body completely or incompletely covers the lower surface of the main body.

* * * * *